United States Patent [19]

Rougerie

[11] Patent Number: 4,494,472

[45] Date of Patent: Jan. 22, 1985

[54] FLOATING AND NONSUBMERSIBLE NAUTICAL CRAFT

[76] Inventor: Jacques Rougerie, 13 rue Chapon, 75003 Paris, France

[21] Appl. No.: 349,531

[22] Filed: Feb. 17, 1982

[30] Foreign Application Priority Data

Feb. 18, 1981 [FR] France ..... 81 03159

[51] Int. Cl.[3] ..... B63B 35/72

[52] U.S. Cl. ..... 114/66; 114/123; 114/61

[58] Field of Search ..... 114/256, 312, 314, 321, 114/338, 339, 123, 259, 66, 313, 330, 125, 333, 341, 121, 61; 405/185, 194

[56] References Cited

U.S. PATENT DOCUMENTS

| | | | |
|---|---|---|---|
| 3,137,263 | 6/1964 | Sainte-Claire | 114/125 |
| 3,613,621 | 10/1971 | McKinley | 114/66 |
| 3,844,241 | 10/1974 | Black et al. | 114/123 |
| 3,996,874 | 12/1976 | Winch | 114/123 |
| 4,276,851 | 7/1981 | Coleman | 114/313 |
| 4,411,213 | 10/1983 | Laukien | 114/333 |
| 4,423,695 | 1/1984 | Rougerie | 114/66 |

FOREIGN PATENT DOCUMENTS

| | | | |
|---|---|---|---|
| 2432430 | 4/1980 | France | 114/259 |
| 2463049 | 2/1981 | France | 114/66 |

*Primary Examiner*—Trygve M. Blix
*Assistant Examiner*—Edwin L. Swinehart
*Attorney, Agent, or Firm*—Darby & Darby

[57] ABSTRACT

A floating, nonsubmersible nautical craft has a hull provided with portholes for observation of the underwater medium. It is buoyed and stabilized, and its draft can be varied. The hull and the apparatus by which it is buoyed and stabilized have a modular structure in transverse sections. The hull is generally tubular in shape, flattened laterally, with a horizontal main axis, with a succession of portholes on each of its longitudinal flanks.

9 Claims, 4 Drawing Figures

FLOATING AND NONSUBMERSIBLE NAUTICAL CRAFT

BACKGROUND OF THE INVENTION

The invention relates to a floating, nonsubmersible nautical craft in particular for the observation, dry, and in constant communication with the atmosphere of the underwater medium.

We are already familiar with many nautical craft, particularly for underwater observation.

In a known variation, the craft has a generally vertical axis of symmetry, and includes an upper buoyancy platform and a vertical well associated with the center of the platform by its upper part, having observation portholes. The well either occupies a position which is fixed relative to the platform or is movable slidably along the axis of symmetry. This known variation has a very large number of drawbacks. The design and shape of the craft (platform and well) make is unsuitable for easy travel, and do not provide satisfactory stability. The draft of the vessel is substantial, and it cannot be used in shallow depths. This draft is invariable or slightly variable. The craft is intended to accommodate a single passenger or a very limited number of passengers.

The sturdiness of the craft, owing to its structure, is dubious. The entry and exit of the passengers to and from the cabin by a steep inside ladder is perilous, this ladder either having to be moved, or will interfere with observation. Thus such a craft is entirely unsuitable for observation of the underwater medium by its passengers under conditions of great comfort and safety.

In another known variation, the craft appears in the general form of a conventional boat hull having a central opening and a cabin with a porthole, pivotally associated with the hull, mounted in the opening between a lower, observation, position and an upper, retracted, position. The cabin can be provided with ballast units, which are likewise movable. This variation also has numerous drawbacks. The association of the cabin with the hull is not very reliable; the displacement of the cabin, in rotation, makes continuous access for entry to or departure therefrom impossible, the stability of the craft is dubious; the craft will not accommodate a large number of passengers, nor can it vary the draft when passengers are in the cabin.

In another known variation, the craft has a pontoon to accommodate passengers, associated with immersed elements, rigidly associated with the pontoon and placed on either side of it. But such a craft by its very nature does not permit underwater observation.

In another known variation, the craft has a vertical axis of symmetry and includes a platform of circular contour under which an immersed observation chamber of toric shape is attached. But this installation is stationary, forming merely an underwater observation gallery and in no case a mobile craft that can travel from a site of embarkation and debarkation to various observation sites. In another known variation, the craft is a conventional vessel, in which the immersed part of the hull has observation portholes. But such a craft remains largely theoretical because its embodiment encounters numerous difficulties; obtention of sufficient draft, solidity, safety.

In another known variation, the craft is a conventional boat with transparent bottom. But such a craft is not designed specifically for observation of the underwater medium; vision is essentially vertical and limited in quality; the observation remains properly speaking, outside the underwater medium.

In another known variation, the craft is a submarine designed to be fully immersed, which involves sophisticated details of tightness, ventilation and safety, and prevents continuous communication with the outer air.

SUMMARY OF THE INVENTION

The object of the invention is to propose a nautical craft intended for observation of the underwater medium, by passengers, neophytes in particular, in more or less large groups (from a few to several dozen persons), under conditions of exceptional comfort and safety, and with a very high quality field of observation and degree of vision. With this in mind, the means of access for the passengers is made very practicable, approaching that of a normal staircase. In the cabin, the passengers are seated, and no element of infrastructure interferes with their vision. The dome-shaped observation portholes increase the quality of the observation, and give the passengers the impression of having "dived" into the underwater medium. The cabin is in communication with the atmosphere. The craft is mobile, on the surface, from an embarkation and debarkation site to various observation sites. The draft of the vessel is variable, permitting good observation of the underwater medium. The stability of the craft is high, owing to the means of buoyancy and stabilization provided.

The invention therefore proposes a nonsubmersible, floating nautical craft constituted on the one hand by a partly immersed hull, for the accommodation of passengers, closed overall, provided, at the top, with means of access normally in continuous communication with the atmosphere, and likewise, portholes for observation of the underwater medium, and on the other hand, by means of stabilization and buoyancy separate from the hull, and perhaps, means for varying the draft, propulsion means and a pilot station, characterized by the fact that the hull and the means of stabilization and buoyancy have a modular structure in transverse sections, the hull having a generally tubular form, flattened laterally, with a horizontal main axis, having a succession of portholes on each of its longitudinal flanks.

According to another characteristic, the means of stabilization and buoyancy have a function of protection of the portholes and a function of improvement of the quality of the observation from the craft by placing the passengers in a back-light.

According to another characteristic, the means of stabilization and buoyancy include a strong supporting structure and mobile lateral floats.

Such a craft is capable, for example, of taking a group of twenty to thirty passengers and actually integrating them totally in the underwater medium, under conditions of comfort and complete physical and psychological security while insuring a very wide field of observation, exceptional viewing quality, and permitting both horizontal movement on the surface and vertical movement in depth.

BRIEF DESCRIPTION OF THE DRAWINGS

The invention will be clearly understood with the aid of the description which follows, of a possible, nonlimiting variation, with reference to the drawings.

DESCRIPTION OF THE PREFERRED EMBODIMENTS

Figure 1:
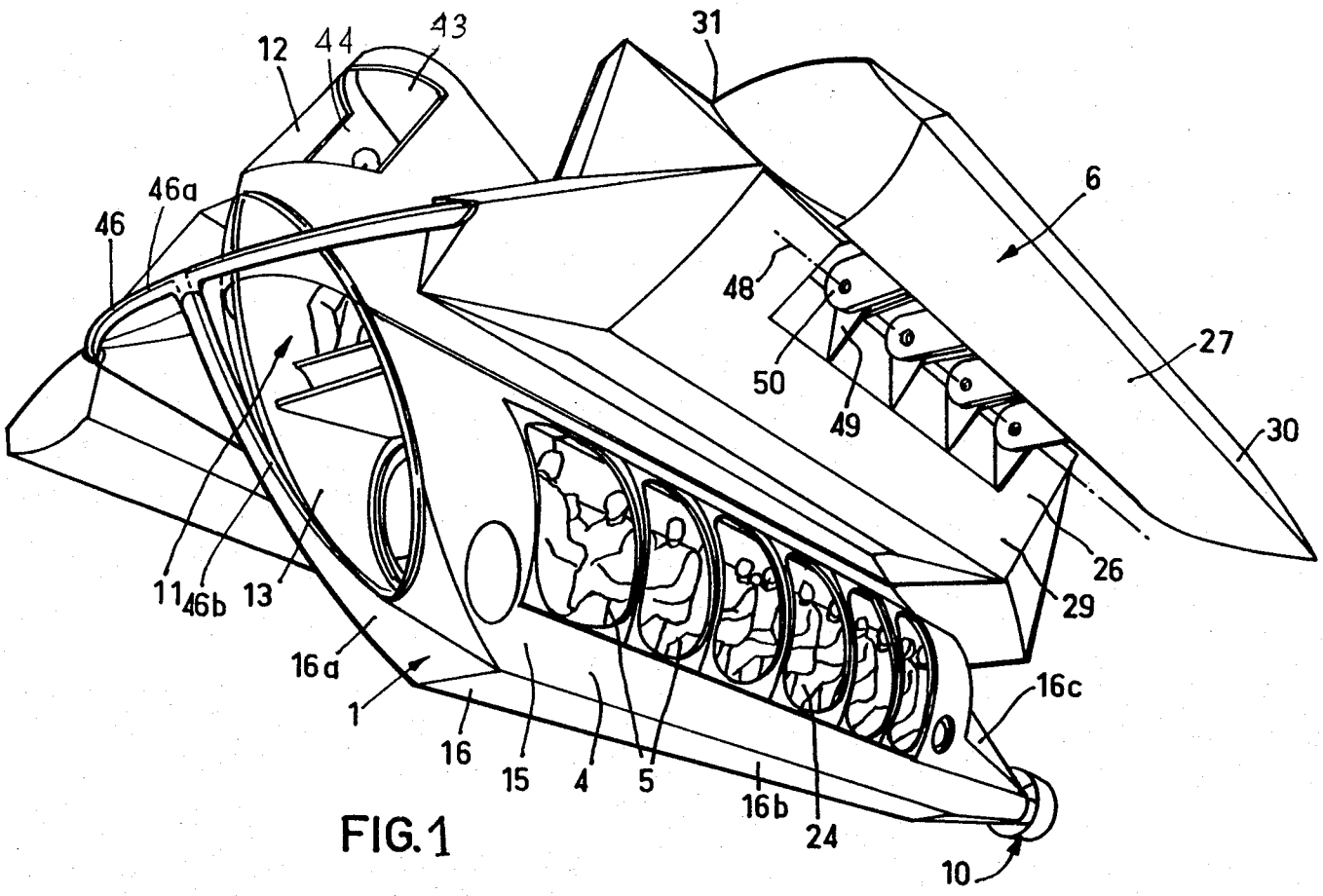
FIG. 1 is a schematic view in perspective, from below, of such a craft.
Figure 2:
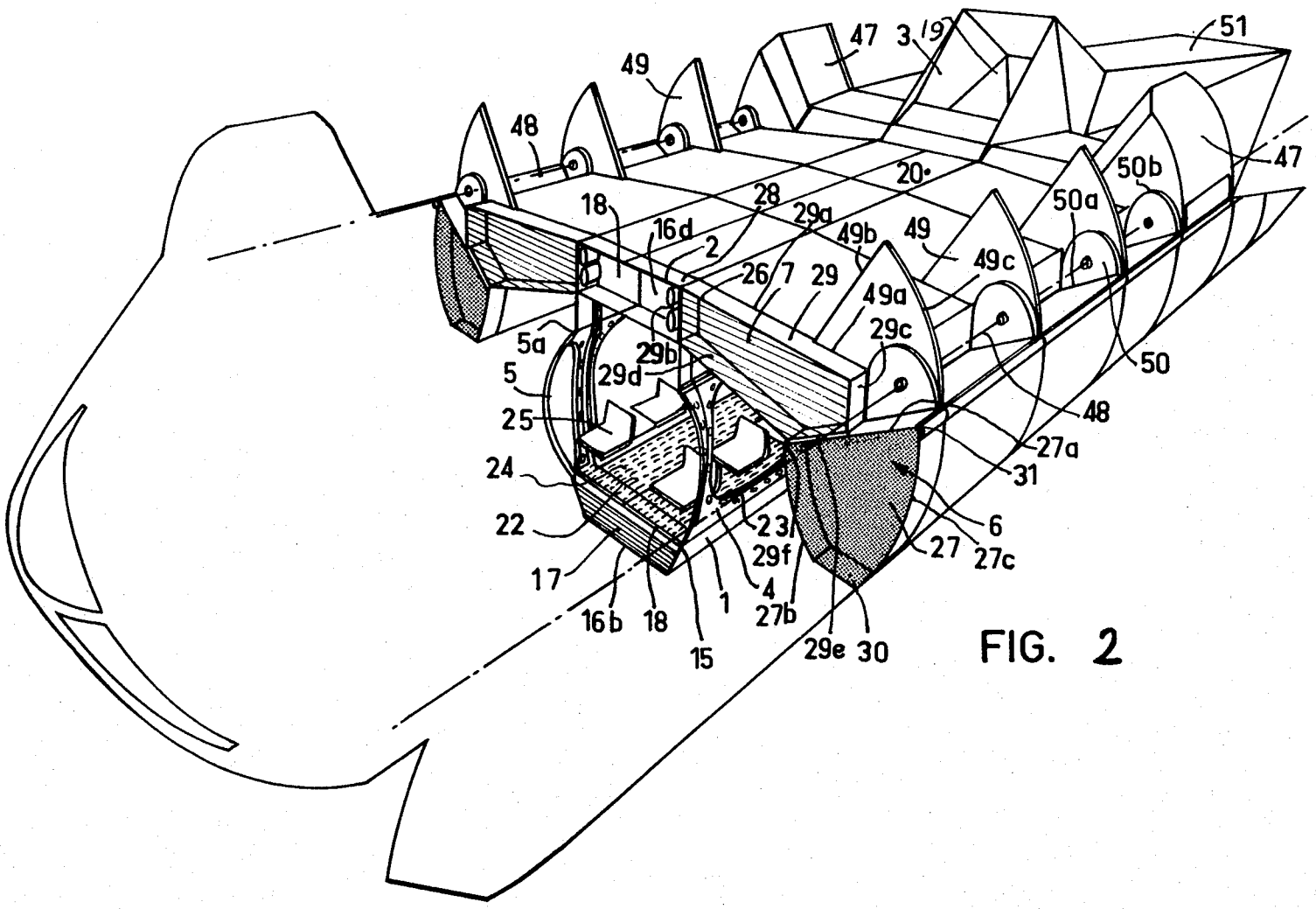
FIG. 2 is a schematic view from above, partly cut away, of the craft in FIG. 1.

The invention relates to a floating nonsubmersible nautical craft comprising, in combination, a rigid hull 1, intended for the accommodation of passengers, entirely closed, provided at the top 2 with means 3 of access for the passengers, normally in continuous communication with the atmosphere, whereof the bottom hull, in particular at least one longitudinal flank 4, is equipped with at least one porthole 5 for observation of the underwater medium by the passengers; and also means 6 of stabilization and buoyancy, structurally and functionally distinct from the hull 1, rigidly associated with the latter, in particular with the top 2 thereof, placed laterally and spaced on either side of the latter, leaving free, substantially in a horizontal direction and downward, the field of observation of the underwater medium by the passengers through the portholes 5.

In a preferred, non-limiting variation, the craft is semi-submersible and also includes, in combination, means 7 of continuous dynamic ballasting to vary the draft, and permit any desired maneuver or position of the craft between two extreme lines of flotation substantially distant from one another, one low 8 and the other high 9, for which the portholes 5 are respectively, on the one hand half in and half out of the water, and on the other hand, substantially immersed, the high flotation line 9 passing in the vicinity of the upper longitudinal border 5*a* of the portholes 5. The distance between the two lines of flotation 8, 9 is comprised, for example, between 30 cm and 1 m, and in particular, 80 cm. In these variations, the draft of the vessel will vary between about 1 and 2 meters.

In a preferred, non-limiting variation, the craft is self-propelled and has means of propulsion 10, placed essentially at the rear and borne by hull 1, and a pilot station 11 provided with means of simultaneous surface viewing 12, and underwater viewing 13.

The craft has a main longitudinal and vertical plane of symmetry P.

The hull 1 has a generally elongate form with a main axis of symmetry 14 that is at least substantially horizontal, for example a tubular form flattened laterally.

Hull 1 has a strong structure 15 comprising the two longitudinal flanks 4 and a median belt 16 composed of a frontal section 16*a*, a lower section 16*b*, a rear section 16*c* and an upper section 16*d*. Frontal section 16*a*, lower section 16*b* and upper section 16*d* each have the general form of a band, pseudo-plane or slightly incurved toward the interior of the craft. Frontal section 16*a* is inclined upward and forward, for example at about 45°. Lower section 16*b* and upper section 16*d* are at least substantially horizontal. The rear section 16*c* has a contorted, complex form, inclined downward and to the rear, in its lower part connecting with lower section 16*b* where, in particular, the means of propulsion 10 are located, and inclined upward and to the rear in its upper part connecting with the upper section 16*d*.

Each longitudinal flank 4 has a generally incurved form, with concavity turned toward plane P with large radius of curvature.

Preferably, the two flanks 4 diverge from one another upwardly, which is an advantage for the strength of the craft, comfort of the passengers, quality of viewing, stability, convenience of access and ventilation.

The lower section 16*b* serves as support for lead ballast 17. Upper section 16*d* and perhaps lower section 16*b* can, with appropriate separations, constitute longitudinal utility channels 18 for ducting, piping, communication, wire, and pneumatic conduits, etc.

The means of access 3 include a first opening 19, offset on the hull 1, hence of the cabin which it defines, made in the belt 16, and in particular in the rear part of upper section 16*d*, preferably inclined upward and to the rear; a longitudinal access platform 20, of generally plane or slightly incurved form, close to upper section 16*d*, associated with, in particular, facing opening 19, oriented, for example, to the rear of the craft, in particular at least in part perpendicular to the rear section 16*c*; and a first permanent inner stairway (not shown) extending between opening 19 and the floor 22 of hull 1 situated above the ballast 17, preferably inclined upward and to the rear in its upper part, and downward and to the rear in its lower part.

The means of access 3 include, in combination, a second opening also offset on the hull 1, hence of the cabin which it defines, made in belt 16, in particular in the forward part of upper section 16*d*, preferably inclined upward and to the front; an evacuation platform, close to upper section 16*d*, associated with, in particular facing the second opening, in particular perpendicular to the median part of upper section 16*d*; and a second inner stairway (not shown) continuously extending between the second opening and the floor 22, preferably inclined upward and forward in its upper part, and downward and forward in its lower part.

Preferably, the second opening is the opening 43 of the pilot station; the traffic platform is co-planar with access platform 20, these platforms being constituted by the base of the structure of the means of stabilization and buoyancy.

The passengers therefore reach the cabin through the first opening 19 and the first stairway, and can leave it by the second stairway and the second opening 43, which makes for a rational traffic plan for the passengers.

Each longitudinal flank 4 contains several portholes 5, in particular a succession (for example six) of identical, aligned portholes 5 placed one after the other, in particular in immediate proximity to one another.

The free edge 23 of porthole 5 is associated rigidly and tightly with the free edge of a corresponding opening made in the longitudinal flank 4, having the general form of a pseudo-ellipse with substantially horizontal long axis, or, preferably, a pseudo-circle.

A porthole 5 is preferably made of blown methacrylate, which makes it possible to obtain dimensions of one or more meters for the larger dimension.

These arrangements insure rigidity and hence a high degree of safety, substantial habitability, great comfort, an extended field of observation, excellent observation quality, and gives the passengers the impression of being surrounded entirely by the underwater element.

Hull 1 thus defines a cabin 24 placed at a level below that of access platform 20 and of the evacuation platform, containing seats 25 and all other provisions for comfort. The seats 25 are oriented longitudinally, for example, in the same direction.

The hull 1, the means 6 and, more generally, the craft, has a modular structure, in transverse "sections", containing a porthole 5 on each flank. This arrangement makes it possible to adapt the capacity of the craft to the desired capacity. For example, the capacity of the craft can vary from about 20 places to about 30 places or more.

As indicated, access to cabin 24 is made possible by the first stairway 21 situated at the rear end of cabin 24 and separated from the portholes 5, whose position does not interfere with the traffic therein or the viewing. Evacuation is by the second stairway situated at the front end of cabin 24, likewise spaced from the portholes 5, and procuring the same advantages as the first stairway 21.

The means of stabilization and buoyancy 6 are of the general catamaran type, associated with hull 1 at the top 2 thereof, in particular with upper section 16*d* and the upper part of flanks 4. They insure the function of stabilization and buoyancy, protect the portholes 5 laterally, and increase the quality of underwater observation from the vessel by placing the passengers in a backlight, preventing them from being bothered by light rays from the surface of the water, which are stopped by means 6. When the craft has means 7 to vary the draft, the means 7 preferably serve as a support for means 6.

The means of stabilization and buoyancy 6 comprise a rigid, strong loadbearing structure 26, rigidly associated with hull 1, as indicated, and two floats 27, placed laterally and at a distance on either side of hull 1.

Structure 26 extends over a substantial part longitudinally, in particular at right angles to lower section 16*d*. It has, in transverse, vertical cross section, the general form of a very flat, inverted pseudo-U, having a base 28 and arms 29 diverging widely downward from one another, and almost coplanar. Arms 29 situated at right angles to lower section 16*b* do not project from frontal section 16*a*.

Preferably, an arm 29 constitutes a chest used to accommodate means for varying the draft of the vessel, when they are present. Such a chest, in cross section, has the form of an irregular pentagon limited by an upper side 29*a* in prolongation of base 28; an inner longitudinal side 29*b*, associated with base 28 and perhaps with hull 1, placed at least substantially vertically; an outer longitudinal side 29*c*, offset and placed opposite the inner longitudinal side 29*b*; an inner, underside 29*d* adjoining the inner longitudinal side 29*b*, oriented transversely outward and downward, and an outer underside 29*e* adjoining the outer longitudinal side 29*c*, oriented transversely inward and downard; inner underside 29*d* and outer underside 29*c* defining a horizontal lower edge 29*f* situated substantially at the level of the upper longitudinal border 5*a* of portholes 5.

Floats 27 are associated with the outer longitudinal sides 29*c* opposite hull 1, and are in the form of chambers filled at least partially with a light material such as polyurethane foam.

Preferably, a float 27, in transverse cross section, has the general form of a curcilinear quadrilateral limited by an inner side 27*a*, rectilinear in particular and associated, as will be seen below, with the adjoining arm 29; an outer side 30 opposite the inner side 27*a*; two lateral sides, respectively an inner one 27*b* and an outer one 27*c*, connecting sides 27*a* and 30, with concavities facing one another and toward the inside of the float, inner side 27*a* and outer lateral side 27*c* define the upper border 31 of float 27.

Figure 3:
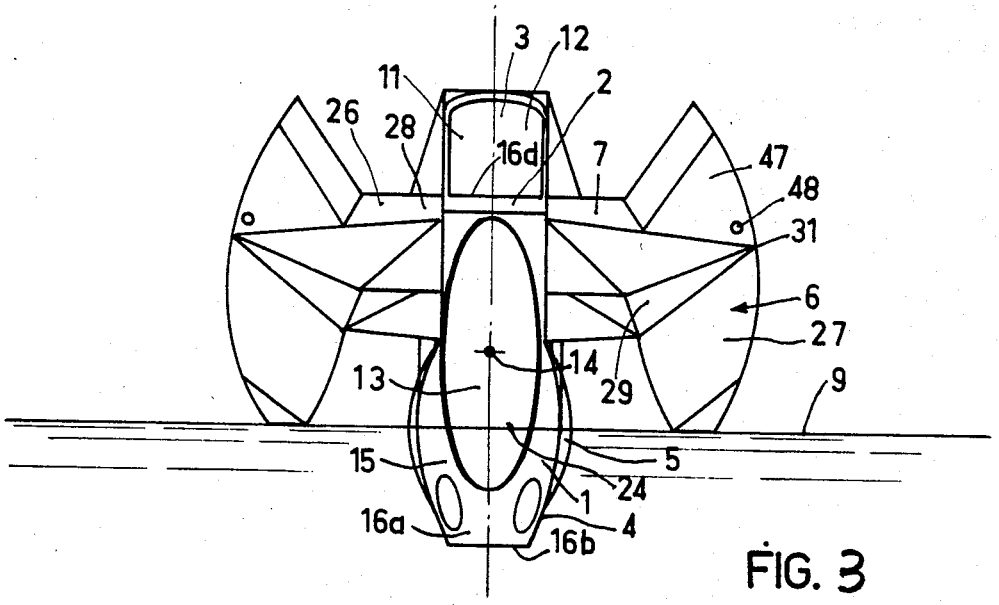
FIGS. 3 and 4 are two frontal schematic views of the craft in FIGS. 1 and 2 with its low and high respectively flotation line.
Figure 4:
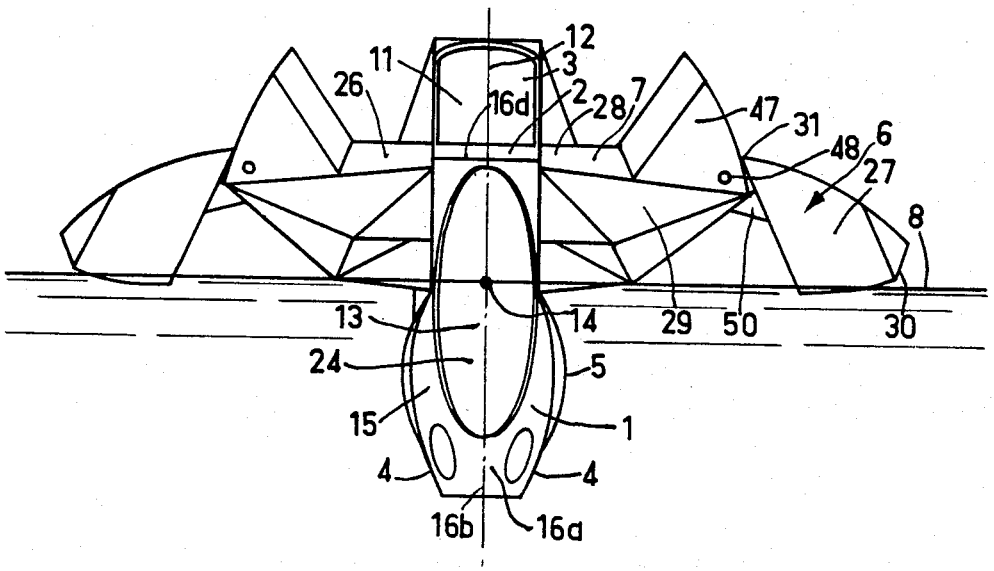

The means of stabilization and buoyancy 6 are flexible, the floats 27 being associated movably with structure 26 between two extreme positions, a low one in which floats 27 (FIG. 3) are oriented downward, and a high one (FIG. 4) in which floats 27 are oriented, generally speaking, at least substantially in the prolongation of base 28 and arms 29. The craft therefore has means of entrainment—not shown—which may be hydraulic or pneumatic, such as jacks, gears, etc. associated with floats 27 and enabling them to be displaced between the two extreme positions, placed, in particular, in chest accommodations 47 placed to the rear and at the top of the craft, in the vicinity of opening 19.

Preferably, the floats 27 are associated with the structure 26, pivotally on axes 48, horizontal and parallel to plane P, situtated substantially in the vicinity of the longitudinal sides of arms 29. For this purpose, structure 26 is provided with transverse cheekplates 49 forming bearing surfaces with which the webs 50 of floats 27 cooperate.

Cheekplates 49 and webs 50 are also modular, like hull 1, the strong structure 26 and floats 27.

A cheekplate 49 has, for example, in elevation, a generally triangular form, limited by an under side 49*a*, adjacent to upper side 29*a* and to outer longitudinal side 29*c*; a straight inner side 49*b* inclined transversely upward from the interior to the exterior of the craft, and an outer side 49*c*, in particular incurved with concavity turned toward plane P.

A web 50 has, for example, in elevation, a generally semicircular form limited by a diametral border 50*a*, adjoining inner side 27*a*, from outer side 27*c*, and a circular border 50*b*. Two webs 50 are placed on either side of a cheek 49.

In a low position, a float 27 has its inner side 27*a* coplanar with the outer, longitudinal side 29*c* of arm 29; its outer side 30 directed downward and substantially at the midpoint of portholes 5, in particular at the same level as the low line of flotation 8, which does not interfere with the horizontal or downward observation of the passengers; its inner lateral side 27*b*, adjoining the edge 29*f*; its outerlateral side 27*c* in the prolongation of outer side 49*c* of cheek 49, sides 27*b* and 27*c* being divided substantially vertically. The assembly of structure 26 and floats 27 then has, in transverse cross section, the general form of an inverted U with widened and incurved base, and thickened arms.

In high position, a float 27 has its inner side 27*a* at a distance from outer longitudinal side 29*c* and oriented transversely downward and to the outside of the craft; its substantially vertical outer side 30 defining the extreme longitudinal border of the craft, furthest from plane P; its outer lateral side 27*c* coming substantially into the prolongation of the upper side 29*a* of arm 29; and its inner lateral side 27*b* placed substantially horizontally, substantially coplanar with the upper longitudinal border 5*a* of portholes 5. The assembly of structure 26 and floats 27 then has, in transverse cross section, a generally elongate form.

In the form of execution considered, floats 27, on one side of the craft, are all rigidly integral and situated in the rectilinear prolongation of one another. But the scope of the invention also includes the case of floats totally or partially independent of one another for every model of the craft. But the scope of the invention also includes the case of floats 27 which are not in the rectilinear prolongation of one another, offset, for example.

Means 7 preserve the stability of the craft, whatever its high or low position. These means 7 can be static, such as ballast or inflatable or mobile structures such as movable floats.

In the variation represented, the means 7 are static, constituted by ballast units lodged in structure 26, in particular the arms 29 which is thus utilized, which, all other things being equal, makes for lightness, reduced bulk and improved appearance of the craft. The ballast units are associated with upper and lower evacuation openings; a hydraulic or other pump for filling ballast, placed, in particular at the rear of the craft.

The ballast units 7 are respectively empty and full when the floats 27 are in their low and high positions. In this case, the craft preferably includes interlocking means between buoyancy and stabilization means 6 and ballasting means 7 to insure their concomitant working.

The propulsion means 10 include a motor, in particular a diesel, placed at any available point on the craft, in particular under a hood 51 placed at the extreme rear of the craft, above upper section **16*d*, under which there can also be the pump for means 7**, controlling a propulsion unit also placed at the rear of the craft.

Means of transmission, for example hydraulic, connect the motor and the propulsion unit.

The pilot station 11 is an accommodation for a pilot, placed in particular in the forward part of the craft, above and in front of cabin 24, accessible through an opening 43 which can be closed by a "cockpit" 44 insuring surface vision. As indicated above, opening 43 also enables the passengers to leave cabin 24.

The means of underwater viewing 13 can be the subject of several variations, for example a porthole placed on the frontal section **16*a* having the general form of a dome shaped as an ellipsoidal cap with horizontal short axis, extending from the floor of cabin 24, to about the level of base 28**.

A stempost 46 insures frontal protection of the craft and of porthole 13 in particular. This post is designed so as not to interfere with vision through porthole 13, which serves the pilot of the craft, but also permits forward vision for the passengers since this porthole 13 is located in cabin 24. This post has, for example, in elevation, a general incurved T shape with a horizontal bar **46*a* rigidly associated at both ends with the tapered, frontal free extreme parts of arms 29, situated substantially at the level of the upper longitudinal border 5*a* of portholes 5; and a vertical bar 46*b* rigidly associated at its lower end with belt 16, in particular with frontal section 16*a* and lower section 16*b***.

It goes without saying that the other variations of embodiment of hull 1, means of access 3, portholes 5, means of stabilization and buoyancy 6, means for varying the draft 7, means of propulsion 10, pilot station 11, means of surface viewing 12 and means of underwater viewing 13, fall within the scope of the invention.

The craft works as follows: initially the craft floats, at the dock at its low flotation line 8, floats 27 being in low position. The passengers use access platform 20, pass through opening 19, reach cabin 24 by stairs 21, and occupy seats 25. The pilot reaches the pilot station 11 through opening 43 of "cockpit" 44. Using the means of propulsion 10, the craft can move horizontally to a desired site, at about 10 knots with great stability owing to the means of stabilization and buoyancy 6, the floats remaining in low position. At any point and any desired moment, as soon as the depth of the water permits, the pilot can cause the craft to float in its high line of flotation 9 so that cabin 24 and portholes 5 are substantially immersed, and the passengers can observe the underwater medium, by acting on the means to vary the draft 7, which is accomplished in two minutes, for example. At the same time, floats 27 move into high position.

At any point and at any desired moment, particularly when the depth of the water requires it, the pilot can vary the line of flotation of the craft and bring it back temporarily to its low line of flotation 8 by emptying ballast units 7, which can be accomplished in less than thirty seconds, merely by gravity; the floats 27 then moving into low position.

I claim:

1. Floating, nonsubmersible nautical craft comprising a partially immersed hull, intended for the accommodation of passengers, closed over all, provided at the top with means of access normally in constant communication with the atmosphere, and portholes for observation of the underwater medium, further comprising means of stabilization and buoyancy separate from the hull and means for varying the draft, means of propulsion and a pilot station, the hull and means of stabilization and buoyancy have a modular structure in transverse section, the hull being of generally tubular shape, flattened laterally, with a horizontal main axis having a succession of portholes on each of its longitudinal flanks, the means of stabilization and buoyancy having, in vertical, transverse cross section, the general form of a flat, inverted U and comprising floats movable between two extreme positions, one being low, in which floats are oriented downward, and the other high, in which floats are oriented at least substantially horizontally, characterized by the fact that the means of stabilization and buoyancy includes a chest having, in transverse cross section, the general form of a pentagon limited by an upper side, an outer longitudinal side, an inner lower side and an outer lower side, the latter two defining a lower edge situated substantially at the level of the upper longitudinal border of portholes.

2. Floating, nonsubmersible nautical craft comprising a partially immersed hull, intended for the accommodation of passengers, closed over all, provided at the top with means of access normally in constant communication with the atmosphere, and portholes for observation of the underwater medium, further comprising means of stabilization and buoyancy separate from the hull and means for varying the draft, means of propulsion and a pilot station, the hull and means of stabilization and buoyancy have a modular in transverse section, the hull being of generally tubular shape, flattened laterally, with a horizontal main axis having a succession of portholes on each of its longitudinal flanks, the means of stabilization and buoyancy having, in vertical, transverse cross section, the general form of a flat, inverted U and comprising a chest and floats respectively connected to said chests on either side thereof, said floats being movable between two extreme positions, one being low, in which floats are oriented downward, and the other high, in which floats are oriented at least substantially horizontally, characterized by the fact that each float has, in transverse cross section, the general form of a curvilinear quadrilateral limited by a rectilinear inner side an outer side opposite the inner side, two lateral sides, an inner one and an outer one with concavities turned toward one another and toward the interior of the float; so that in low position, the float has its inner side coplanar with the outer lower side of said chest, its outer side oriented downward and substantially at mid-height of the portholes, at the same level as the low line of flotation, and that in high position, the float has its inner side away from said chest and oriented transversely downward and toward the outside of the craft; its substantially vertical outer side defining the extreme longitudinal border of the craft furthest from the vertical plane of symmetry, its inner lateral side placed substantially horizontally, substantially at the level of the upper longitudinal border of the portholes.

3. Nautical craft according to claim 1 or 2, characterized by the fact that the floats are pivotally mounted on axes horizontal and parallel to the main plane of symmetry of the craft, further comprising webs connected to said floats and transverse cheekplates forming a bearing surface with which said webs cooperate.

4. Nautical craft according to claim 1 or 2 further comprising ballasting means and means of interlocking the position of the floats as a function of the state of filling of the ballasting means so that floats will be in low position when the ballasting means are empty and in high position when the ballasting means are full.

5. Nautical craft according to claim 1 or 2, characterized by the fact that it has means of entrainment permitting the relative displacement of the floats.

6. Nautical craft according to claim 1 or 2, characterized by the fact that the portholes have a general dome shape.

7. Nautical craft according to claim 1 or 2, characterized by the fact that the means of access include a pair of openings, one being in a forward location and the other in an after location in said hull.

8. Nautical craft according to claim 1 or 2, characterized by the fact that the means of surface viewing comprising a porthole placed on the frontal section, having the general shape of a dome in the form of an ellipsoidal cap with horizontal short axis.

9. Nautical craft according to claim 1 or 2 further comprising a belt at the bottom of the hull and a protective stem post having, in elevation, the general form of an incurved T, with a horizontal bar situated substantially at the level of the upper, longitudinal border of the portholes; and a vertical bar rigidly associated at its lower end with the belt.

* * * * *